US005210377A

United States Patent [19]

Kennedy et al.

[11] Patent Number: 5,210,377

[45] Date of Patent: May 11, 1993

[54] COAXIAL ELECTRIC SIGNAL CABLE HAVING A COMPOSITE POROUS INSULATION

[75] Inventors: Francis A. Kennedy, Elkton, Md.; William G. Hardie, Newark; Jack J. Hegenbarth, Wilmington, both of Del.

[73] Assignee: W. L. Gore & Associates, Inc., Newark, Del.

[21] Appl. No.: 827,309

[22] Filed: Jan. 29, 1992

[51] Int. Cl.[5] ..... H01B 11/18

[52] U.S. Cl. ..... 174/107; 174/36; 174/110 F; 174/110 FC; 174/120 R

[58] Field of Search ..... 174/120 R, 120 SR, 110 F, 174/110 FC, 107, 36

[56] References Cited

U.S. PATENT DOCUMENTS

| | | | |
|---|---|---|---|
| 3,309,458 | 3/1967 | Yoshimura et al. | 174/107 |
| 3,567,846 | 3/1971 | Brorein | 174/102 R |
| 3,927,247 | 12/1975 | Timmons | 174/36 |
| 3,953,566 | 4/1976 | Gore | 264/288 |
| 4,330,685 | 5/1982 | Bleikamp, Jr. | 174/101.5 |
| 4,394,460 | 7/1983 | Chung et al. | 521/92 |
| 4,638,114 | 1/1987 | Mori | 174/36 |
| 4,649,228 | 3/1987 | Suzuki | 174/36 |
| 4,701,576 | 10/1987 | Wada et al. | 174/117 F |

*Primary Examiner*—Morris H. Nimmo
*Attorney, Agent, or Firm*—Gary A. Samuels

[57] ABSTRACT

A crush-resistant high signal propagation velocity coaxial cable insulated with a low-density expanded PTFE insulation surrounded by an extruded closed-cell polymer foam.

15 Claims, 1 Drawing Sheet

COAXIAL ELECTRIC SIGNAL CABLE HAVING A COMPOSITE POROUS INSULATION

FIELD OF THE INVENTION

The invention pertains to insulated coaxial electric signal cables, particularly to those cables having a porous insulation, most particularly to those cables wherein the porous insulation comprises a fluorocarbon polymer.

BACKGROUND OF THE INVENTION

Low-density porous expanded polytetrafluoroethylene (PTFE), described in U.S. Pat. Nos. 3,953,566, 3,962,153, 4,096,227, 4,187,390, 4,902,423, and 4,478,665, has been widely used to insulate electrical conductors to provide insulated conductors having improved properties of velocity of signal propagation, dielectric loss, and physical dimensions as compared to conductors insulated with full density polymer insulation. The high pore volume and low-density provide the improvements in the properties.

A limitation to achieving extremely high signal propagation velocity through such insulated conductors lies in the open cell (nodes and fibrils) nature of ePTFE which is not inherently crush-resistant when it is manufactured to have a very high void content or pore volume to achieve low-density and low dielectric constant and therefore high velocity of signal propagation.

Crushability of such an insulation can be improved by enclosing the insulation with a skin of thermoplastic polymer, but the velocity of signal propagation is reduced by the solid voidless insulation skin.

Another method for providing crush-resistance to the cable insulation has been to foam thermoplastic polymers as they are being extruded around a conductor to yield a crush-resistant closed cell foam insulation around the conductor. The method is well known in the art and described in U.S. Pat. Nos. 3,072,583, 4,711,811, and 4,394,460 and in EP0442346 in which a foaming gas or liquid is injected into the molten polymer during extrusion. In these methods a foaming agent is used during the extrusion process to yield closed cell fluorocarbon polymer foams, which tend to be inherently crush-resistant. It is difficult, however, to produce a foam insulation having a high enough void content to provide insulated cables having high signal velocity propagation through them and at the same time provide adequate resistance to crushing.

SUMMARY OF THE INVENTION

The invention comprises a coaxial electric signal cable having a composite porous insulation comprising a layer of porous ePTFE insulation surrounding a signal conductor and this insulated conductor surrounded by a layer of closed-cell foam polymer insulation. The ePTFE insulation may be extruded or tape-wrapped onto the signal conductor and the closed-cell foam polymer insulation may be any customary insulation useful for conductor insulation which can be foamed by a foaming agent as it is extruded onto the ePTFE-clad conductor. A thermoplastic fluorocarbon polymer is preferred for the foamed closed-cell polymer, such as PFA, FEP, or the like, for example, and may also be polyester, polypropylene, or polyethylene. The foamed closed-cell polymer may be either extruded over the ePTFE layer or applied as a tape wrap. The composite insulation of the invention combines a microporous open-celled insulation of nodes and fibrils with a crush-resistant protective insulation of high closed-cell void-content which does not adversely affect the electrical properties of the ePTFE-clad conductor, particularly its signal propagation velocity.

The insulated signal conductor having the two-layer composite insulation is provided with electrical shielding of a type customary for shielding in coaxial electric signal cables, such as metallized polymer tape, metal foil, served metal wires, or metal tubes, for example. The shielding is usually surrounded by a protective polymeric jacket, which may be tape-wrapped or extruded over the shielding. Such jackets may be of polyolefins, polyvinyl chloride, fluoropolymers, and the like, which may also be filled with conductive materials. The signal conductor and the shielding may be copper, copper alloy, noble metal-plated copper, aluminum, mu metal magnetic alloy, or other conductive metal.

The insulated signal conductor having the two-layer composite insulation may be utilized as a twisted pair of insulated conductors without shielding and thus take advantage of the crush resistance and good dielectric properties of the composite insulation.

DETAILED DESCRIPTION OF THE INVENTION

The invention is now described in detail with reference to the drawings to more carefully delineate the details and scope of the invention.

Figure 1:
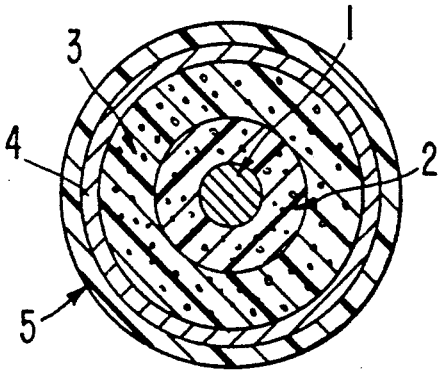
FIG. 1 is a cross-sectional view of a cable of the invention.

FIG. 1 is a cross-sectional view of a cable of the invention in which an electrical signal conductor 1 is surrounded by extrusion or tape-wrapping by a layer of preferably porous expanded polytetrafluoroethylene (ePTFE) insulation 2. The insulated conductor is surrounded by a layer of closed-cell polymer foam insulation 3 which is preferably extruded onto the ePTFE covered conductor by methods described above which embody extruding under heat and pressure a foamable thermoplastic onto a core while at the same injecting an unreactive gas or gasefiable liquid into the extruder barrel to effect foaming of the thermoplastic as it exits the extruder. A nucleating agent has been added to the thermoplastic polymer before extrusion so as to thereby maximize the number of voids formed and minimize their size. This procedure causes the foamed polymer layer 3 to be closed-celled with considerable strength against crushing.

About 95% void content is about the maximum usefully attainable and the preferred range is about 50–90% void content, which will provide maximum signal propagation velocity with good crush-resistance in a coaxial signal cable.

Other microporous polymers having very low dielectric constants may be substituted for the preferred ePTFE, such as polyethylene, polypropylene, fluorocarbons, for example.

The center signal conductor 1 may be solid or stranded and may comprise copper, copper alloy, aluminum, aluminum-copper composite, carbon-filled polymer, metals coated with other metals by a plasma coating method, noble metal-plated copper and copper alloys, or tin and nickel-plated metals, for example.

Foamable thermoplastic polymers which may be used for the closed-cell foam insulation 3 may include polyethylene, aromatic polyamide, polypropylene, fluorinated ethylene-propylene copolymers (FEP), perfluoroalkoxy tetrafluoroethylene polymers (PFA), chlorotrifluoroethylene polymers, ethylene-chlorotrifluoroethylene copolymers, polyvinylidene fluoride polymers, PTFE polymers containing fluorinated oxygen-containing rings, polystyrene, polyformaldehyde polyethers, vinyl polymer, aromatic and aliphatic polyamides, and ethylene-tetrafluoroethylene copolymers (Tefzel ®).

Foaming agents may be nitrogen, members of the Freon ® series, carbon dioxide, argon, neon, methylene chloride, or low-boiling hydrocarbons, such as pentane, for example. Under extrusion conditions in a thermoplastic polymer, these will form the closed-cell voids in large numbers, particularly if a nucleating agent is used.

To insure that the maximum number of minimum sized voids are formed, a nucleating agent to promote bubble formation is used. These may include particles of boron nitride, a magnesium, calcium, barium, zinc, or lead oxide or carbonate, alumina, silica gel, and titanium dioxide, for example.

Surrounding the closed-cell foamed insulation 3 is a conductive shielding 4, which may be wrapped, served, or extruded around insulation 3. Metal foils or metal-coated polymer tapes may be spiralled around insulation 3 or conductive wire or tape served or braided around insulation 3. A soft conductive metal tube of copper, copper alloy, or aluminum may be drawn through a die around insulation 3. A silver-plated copper wire may be served around insulation 3. Conductive shielding 4 may comprise the same metals used above for the center conductor 1 and may also be mu metal magnetic alloy or conductive particle-filled polymer containing conductive carbon or metal particles, for example. Where a metal-coated polymer tape is used for the shielding 4, a spiralled or longitudinal drain wire 6 is often used adjacent and in contact with the shield to insure proper grounding of the shield. The drain wire may be of silver-plated copper, for example.

Surrounding the shield 4 and alternative drain wire 6 is a protective jacket 5. Jacket 5 is usually an extruded thermoplastic, such as those listed above, and may contain conductive filler particles of carbon or metal.

Figure 2:
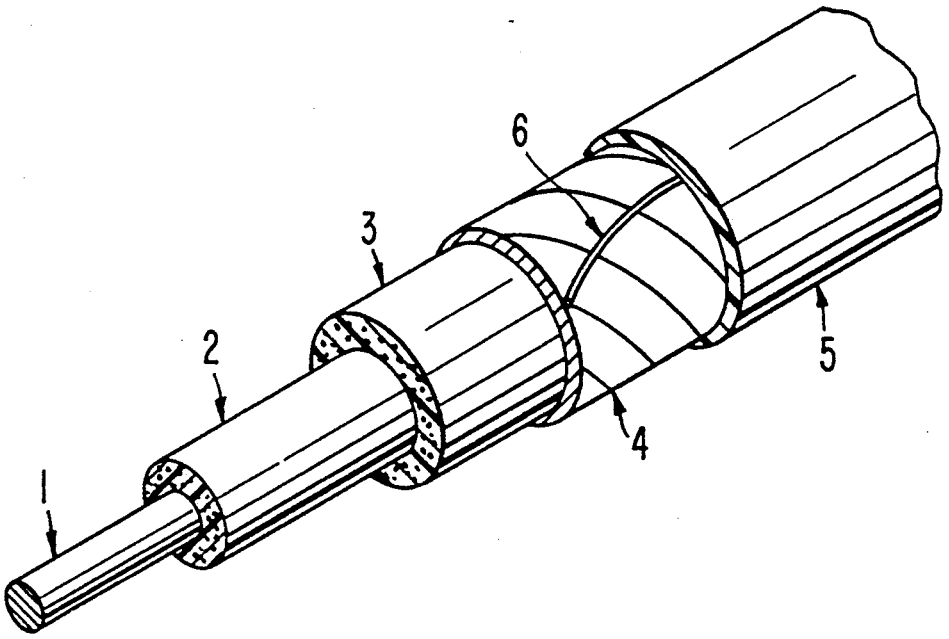
FIG. 2 is a perspective view of a cable of the invention with various layers cross-sectioned and removed from the cable for convenient viewing.

FIG. 2 describes a cable of the invention in a perspective cross-sectional view with layers successively peeled away to show the structure of the cable. Conductor 1 is surrounded by an ePTFE insulation layer 2, which is a turn surrounded by a closed-cell foam insulation 3 to provide crush strength to protect the microporous layer 2. The foam insulation 3 is shown wrapped spirally by a metal tape or metal-coated tape shielding 4. A drain wire 6 adds to the effective grounding of the shield. A protective polymer Jacket 5 in turn surrounds shield 4 and drain wire 6.

EXAMPLE

A 0.762 mm silver-plated copper wire was spirally-wrapped with an ePTFE tape having a density of 0.21 g/cc and a void content of about 90% as calculated, based on the density. A foamed fluoropolymer layer was extruded over the ePTFE. The density of the ePTFE layer and the foamed thermoplastic layer were measured by the following procedure.

A small piece of cable was submerged in epoxy potting compound and placed in a vacuum chamber to pull air from the samples. The epoxy potting compound is allowed to cure and the samples then cross-sectioned and polished.

A microscope with a video micrometer is then used to measure the diameter of the signal conductor, the diameter of the ePTFE core, and of the foamed thermoplastic polymer layer. A cross-sectional area can then be calculated for the ePTFE and the foamed thermoplastic polymer layer. An adjoining 12 inch (30.48 cm) sample of the cable is then separated into its component parts and the ePTFE and the thermoplastic polymer layer weighed separately and the mass determined. The volume of each layer can be calculated by the cross-sectional area times the 12 inch (30.48 cm) length. The density is then calculated from the mass in grams for each layer divided by the volume in cubic centimeters. The density of the ePTFE layer averaged about 0.21 g/cc., with a range of about 0.19 to about 0.28 g/cc. The wall thickness of the ePTFE layer was measured as about 0.294 mm.

A crush-resistant layer of PFA was then extruded by a standard extruder for thermoplastic polymer extrusion onto the ePTFE wrapped conductor while Freon 113 was injected into the barrel of the extruder. The extruder had a 30:1 length to diameter ratio. The PFA contained a boron nitride nucleating percent at about 0.79% by weight. Several samples were extruded having from about 0 to about 55% void content in the PFA layer. These void contents were confirmed by removing the PFA layer and measuring the density of the PFA layer.

A spiral drain wire and aluminized polyester shield were applied in tandem by a tape-wrapping method known in the art. An extruded layer of FEP was added by a standard extrusion process to serve as an outer jacket. These samples were tested for velocity of signal propagation and the results compared with those of otherwise identical samples, having no outer jacket. The data from these measurements showed that as the void content of the PFA skin layer increased, the velocity of signal propagation of the cable increased correspondingly with little change of the ability of the PFA skin layer to prevent crushing of the ePTFE insulation core.

We claim:

1. A coaxial electric signal cable comprising from inside to outside:

(a) an electrically conductive signal conductor;

(b) a first layer of microporous insulation surrounding said conductor; and (c) a second layer of closed-cell polymer foam insulation surrounding said first layer of insulation.

2. A cable of claim 1 comprising an electrically conductive shielding surrounding said second layer of insulation and a protective polymeric jacket surrounding said shielding.

3. A cable of claims 1 or 2 wherein said first layer of microporous insulation comprises expanded polytetrafluoroethylene.

4. A cable of claim 3 wherein said second layer of insulation comprises an extruded layer of closed-cell thermoplastic polymer foam.

5. A cable of claim 4 wherein said foam has a void content of about 5 to 95%.

6. A cable of claim 4 wherein said foam has a void volume of about 50 to 90%.

7. A cable of claim 4 wherein said thermoplastic polymer foam is selected from the group consisting of polyethylene, polypropylene, polyester, fluoropolymer, fluorinated ethylenepropylene copolymers, perfluoroalkoxy tetrafluoroethylene polymers, chlorotrifluoroethylene polymers, ethylenechlorotrichloroethylene copolymers, polyvinylidene fluoride polymers, polytetrafluoroethylene polymers containing fluorinated oxygen containing heterocyclic rings, polystyrene, polyformaldehyde polyethers, vinyl polymers, aromatic and aliphatic polyamides, and ethylene-tetrafluoroethylene copolymers.

8. A cable of claim 3 wherein said expanded polytetrafluoroethylene insulation is tape-wrapped or extruded onto said signal conductor.

9. A cable of claim 2 wherein said electrically conductive shielding and said signal conductor comprise metals.

10. A cable of claim 9 wherein said metals are selected from the group consisting of copper, copper alloy, noble metal-plated copper, copper alloy, and aluminum, aluminum, aluminum-copper composite, metals coated with another metal by plasma coating processes, steel, tin and nickel-plated metals, and mu metal magnetic alloy.

11. A cable of claim 2 wherein said jacket comprises an extruded thermoplastic polymer.

12. A cable of claim 11 wherein said thermoplastic polymer contains a conductive filler.

13. A cable of claim 2 comprising additionally a conductive metal drain wire positioned adjacent to and in contact with said conductive shielding.

14. A process for preparing a coaxial electric signal cable comprising the steps:

(a) enclosing an electrically conductive signal conductor with a first insulation layer of porous expanded polytetrafluoroethylene;

(b) enclosing said first insulation layer with a second insulation comprising a closed-cell polymer foam;

(c) enclosing said second insulation layer with a layer of electrically conductive metal shielding;

(d) optionally positioning an electrically conductive drain wire adjacent to and in contact with said shielding; and (e) optionally enclosing said shielding layer with a protective polymeric jacket.

15. Two or more cables of claim 1 twisted together into a single cable.

* * * * *